US007250919B2

(12) United States Patent
Wong et al.

(10) Patent No.: US 7,250,919 B2
(45) Date of Patent: Jul. 31, 2007

(54) ANTENNA

(75) Inventors: Kin-Lu Wong, Kaohsiung (TW); Saou-Wen Su, Taipei (TW); Chih-Hsien Wu, Taipei (TW); Chia-Lun Tang, Miaoli (TW); Shyh-Tirng Fang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/942,925

(22) Filed: Sep. 17, 2004

(65) Prior Publication Data

US 2005/0237257 A1 Oct. 27, 2005

(30) Foreign Application Priority Data

Apr. 26, 2004 (TW) ..... 93111582 A

(51) Int. Cl.
*H01Q 1/48* (2006.01)
*H01Q 9/28* (2006.01)

(52) U.S. Cl. ..... 343/846; 343/845; 343/795

(58) Field of Classification Search ..... 343/846, 343/794, 845, 795

See application file for complete search history.

(56) References Cited

U.S. PATENT DOCUMENTS 3,488,657 A * 1/1970 Loudon et al. ..... 343/708
5,229,777 A * 7/1993 Doyle ..... 343/700 MS
6,130,650 A * 10/2000 Curtis et al. ..... 343/846
6,344,833 B1 * 2/2002 Lin et al. ..... 343/846
2002/0158807 A1 10/2002 Kuramoto
2003/0011525 A1 * 1/2003 Sanad ..... 343/702
2003/0156064 A1 * 8/2003 Bancroft et al. ..... 343/700 MS

FOREIGN PATENT DOCUMENTS

EP 1130677 A2 9/2001
JP 2000-40917 A 2/2000
JP 2003368532 * 4/2002
JP 2002-368532 A 12/2002

* cited by examiner

*Primary Examiner*—Don Wong
*Assistant Examiner*—Angela M Lie
(74) *Attorney, Agent, or Firm*—Birch, Stewart, Kolasch & Birch, LLP

(57) ABSTRACT

An antenna. The antenna comprises a convex ground unit, a radiating member disposed above the ground unit and a feed member connected to the radiating member. The radiating member comprises a first sub-radiating member and a second sub-radiating member having a feed point to which the feed member is connected.

21 Claims, 4 Drawing Sheets

ANTENNA

This Non-provisional application claims priority under 35 U.S.C. § 119(a) on Patent Application Ser. No(s). 093111582 filed in Taiwan, Republic of China on Apr. 26, 2004, the entire contents of which are hereby incorporated by reference.

BACKGROUND

The present invention relates to an antenna, and in particular to an antenna with a uniform half-space radiation pattern.

As wireless local area networks (WLANs) proliferate, wireless networking is more popular. Access point antennas are, thus, highly valued. For WLAN access-point applications in different operation environments, various radiation patterns in the horizontal (azimuthal) plane, such as an omnidirectional radiation pattern or a half-space radiation pattern in one direction, are required for the mounting antennas.

For omnidirectional radiation, a monopole antenna is preferable. For half-space radiation, however, an additional metal reflector with a particular shape is added to the monopole antenna structure. US patent application publication No. 2002/0158807 A1 discloses a cylindrical metal reflector device with a specific opening for adjusting the radiation pattern of a monopole antenna, thereby creating the half-space radiation pattern. Such a structure (one monopole antenna and a reflector with a particular shape) is, however, oversized and complicated.

European patent No. 1,130,677 discloses a patch antenna comprising a patch element disposed above a flat ground plane. By adjusting an additional metal reflector cooperated with the ground plane, the radiation beam width, of 180° for uniform half-space radiation, can be enlarged. However, the radiation beam width of the patch antenna, however, can only reach 110°.

Japan patent No. JP2002-368532 discloses a microstrip antenna having a bulged ground plane and a lens-like structure formed by dielectric material to improve the radiation characteristics at low elevation. The improvement of the radiation beam width is, however, still non-obvious.

Japan patent No. JP2000-040917 discloses a cylindrical antenna provided with a circular radiating member and a circular ground plane. Such an antenna has a complicated structure and offers only limited improvement in enlarging the radiation beam width.

SUMMARY

Accordingly, embodiments of the invention provide novel designs of an access point antenna. The azimuthal (horizontal) radiation pattern is provided with a 3 dB beamwidth of 180° which covers one half-space. The antenna structure of the invention is simple, easier to manufacture, small and has lower cost.

An embodiment of the antenna of the invention comprises a convex ground unit, a radiating member disposed above the ground unit and comprising a first sub-radiating member and a second sub-radiating member having a feed point and a feed member connected to the feed point.

The ground unit comprises a first ground surface having a first side and a second side opposite to the first side, a second ground surface connected to the first side to define a first angle and a third ground surface connected to the second side to define a second angle. The first and second angles are between 150° and 110°. The second ground surface has the same shape as the third ground surface.

The feed member is a metal rod with one end connected to the feed point via the via-hole without contact and the other end connected to a signal source (not shown). The antenna can be employed in a wireless local network operating in the 2.4 GHz band, and the horizontal 3 dB beamwidth approaches 180°.

An appropriate operating bandwidth of the antenna of one embodiment of the invention is available by setting the length of the first sub-radiating member to be less than ½ the wavelength corresponding to the center operating frequency of the antenna. The triangular second sub-radiating member contributes to good impedance matching of the antenna. A good impedance match of the antenna can be obtained by setting the distance between the first sub-radiating member and the ground plane to be less than ⅙ the wavelength corresponding to the center operating frequency of the antenna. By setting the first and second angles to be between 110° and 150°, the 3 dB beamwidth can approach 180°. An access point antenna for a wireless local network operating in the 2.4 GHz band is thereby obtained, and the radiation pattern thereof covers one half-space.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION

FIRST EMBODIMENT

Figure 1:
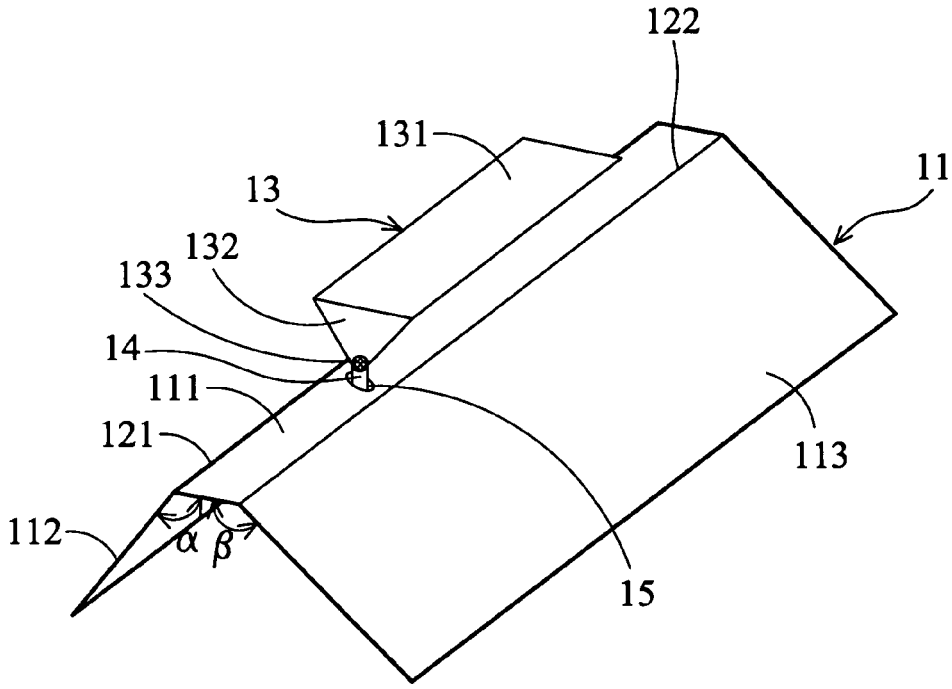
FIG. 1 is a perspective view of an embodiment of the antenna of the invention.

FIG. 1 is the first embodiment of the antenna of the invention. The first embodiment of the antenna comprises a convex ground unit 11 configured in an inverted-V shape rising high above horizontal, a radiating member 13 and a feed member 14.

The convex ground unit 11 can be formed by bending a metal plate or assembling, by welding for example, at least two metal plates. The convex ground unit 11 comprises a first ground surface 111, a second ground surface 112 and a third ground surface 113. The first ground surface 111 having a via-hole 15 is the middle portion of the ground unit 11 and has a first side 121 and a second side 122 opposite to the first side 121. The second ground surface 112 is connected to the first side 121 to define a first angle α. The first angle α is between 110° and 150° in this embodiment. The third ground unit 113 is connected to the second side 122 to define a second angle β. The second angle β is also between 110° and 150° in this embodiment. The second and third ground surfaces 112, 113 have the same shape and one positioned symmetrically with respect to the first ground surface 111.

In this embodiment, the radiating member 13 configured in an inverted L shape comprises a first sub-radiating member 131 (aspect ratio, the ratio of length over width, is greater than 3) and a second sub-radiating member 132. The radiating member 13 can be formed by bending a metal plate or assembling, by welding for example, two metal plates. The first sub-radiating member 131 is parallel to and separated from the first ground surface 111 by a distance of ⅙ the wavelength corresponding to the center operating frequency of the antenna and has a length less than ½ the wavelength corresponding to the center operating frequency of the antenna. The second sub-radiating member 132 is triangular and perpendicular to the first ground surface 111. The apex of the triangle adjacent to the first ground surface 111 serves as a feed point 133 connected with the feed member 14. The feed member 14 is a metal rod in this embodiment with one end connected to the feed point 133 via the via-hole 15 without contact and the other end connected to a signal source (not shown) for signal transmission. The width of the first ground surface 111 is less than ½ the width of the second and third ground surfaces 112, 113. Radiation energy, thereby, has a uniform distribution in a large radiation beam width to provide a uniform one half-space radiation pattern.

Figure 2:
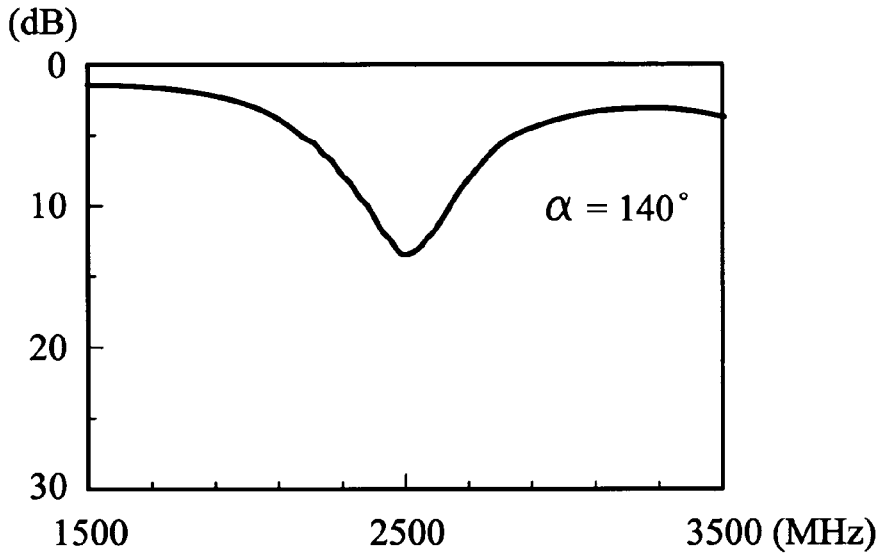
FIG. 2 is a return loss diagram of an embodiment of the antenna of the invention.

FIG. 2 shows the return loss of this embodiment of the invention. The size of the antenna of this embodiment is determined by the rectangular first ground surface 111 having a length of 210 mm and a width of 9 mm, the rectangular second and third ground surfaces 112, 113 having a length of 210 mm and a width of 140 mm, the rectangular first sub-radiating member 131 having a length of 70 mm and a width of 20 mm, the triangular second sub-radiating member 132 having a height of 11 mm and two sides length of 15 mm with the first and second angles α, β of 140°. In FIG. 2, the vertical axis represents the return loss, and horizontal axis the operating frequency. As the acceptable operating frequency is defined as the corresponding return loss less than 10 dB, the useful operational band of the antenna of this embodiment includes the commercial band of 2.4 GHz (2400-2484 MHz).

Figure 3A:
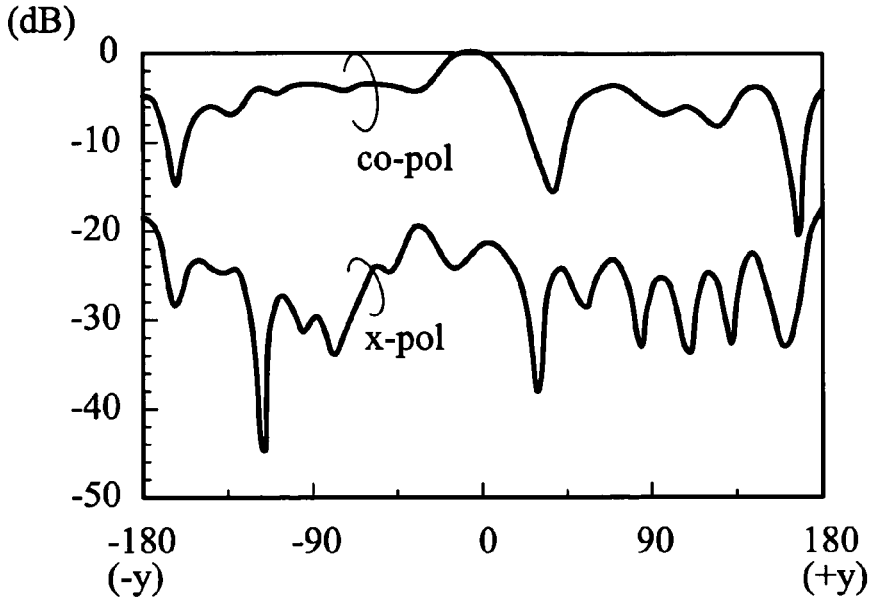
FIG. 3*a* shows E-plane (vertical plane) radiation pattern of an embodiment of the antenna of the invention at 2442 MHz.
Figure 3B:
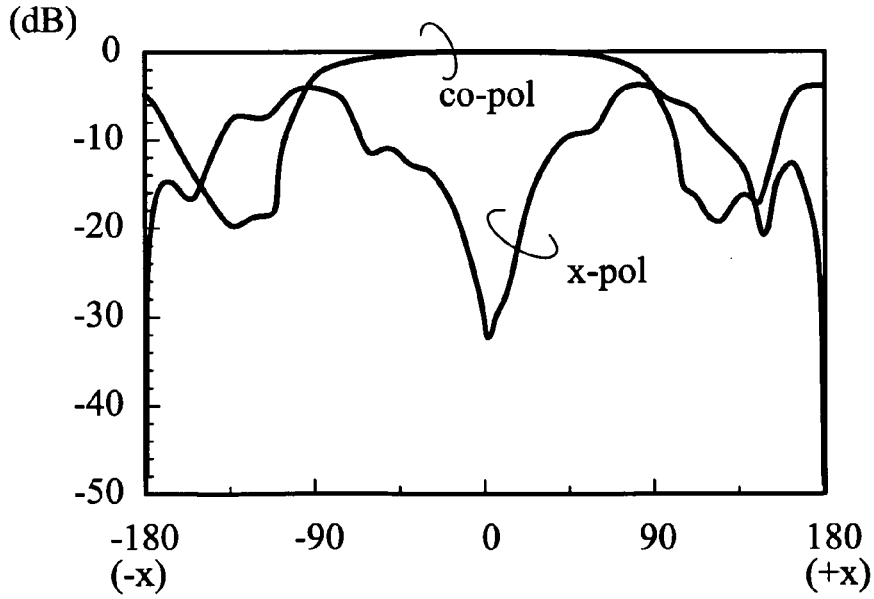
FIG. 3*b* shows H-plane (horizontal plane) radiation pattern of an embodiment of the antenna of the invention at 2442 MHz.

FIGS. 3*a* and 3*b* shows the radiation pattern of the antenna of this embodiment at an operating frequency of 2442 MHz. FIGS. 3*a* and 3*b* shows the radiation pattern in E plane (vertical plane) and H plane (horizontal plane) respectively. The vertical axis means radiation intensity, and horizontal axis means azimuth. In FIG. 3*a*, the beamwidth of the co-pol radiation pattern is 35°. In FIG. 3*b*, the beamwidth of the co-pol radiation pattern is near 180°. This means that the radiation pattern of this embodiment of the invention is uniformly distributed in one half-space. In certain experiments, the radiation beam width of the horizontal plane can be greater than 170° when α and β are between 110° and 150°.

Figure 4:
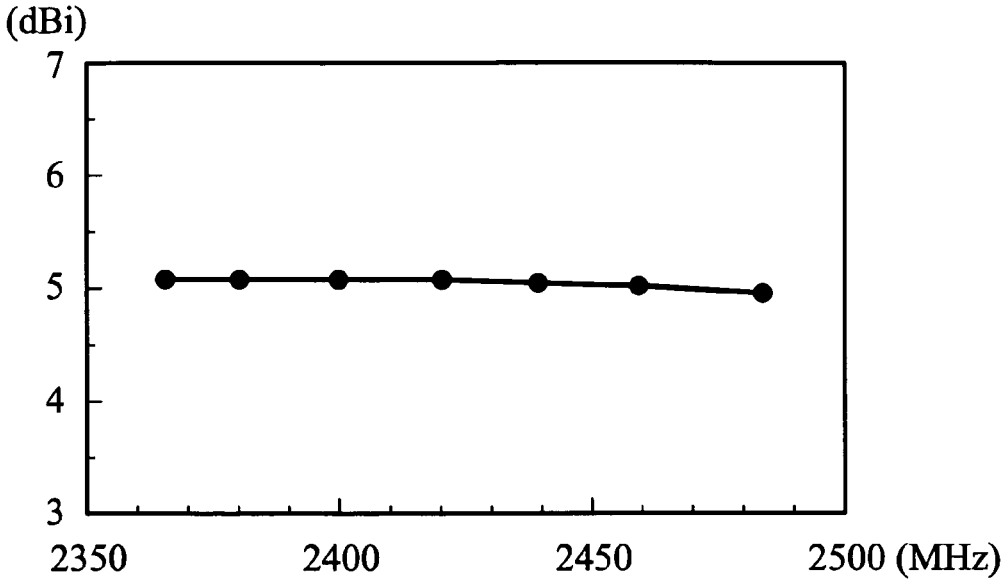
FIG. 4 is a gain diagram of an embodiment of the antenna of the invention.

FIG. 4 shows measured antenna gain of this embodiment for frequencies across the 2.4 GHz WLAN band. The vertical axis represents the gain, and the horizontal axis the operating frequency. In the result, the antenna gain is about 4.9-5.1 dBi which satisfies the commercial requirement.

SECOND EMBODIMENT

Figure 5:
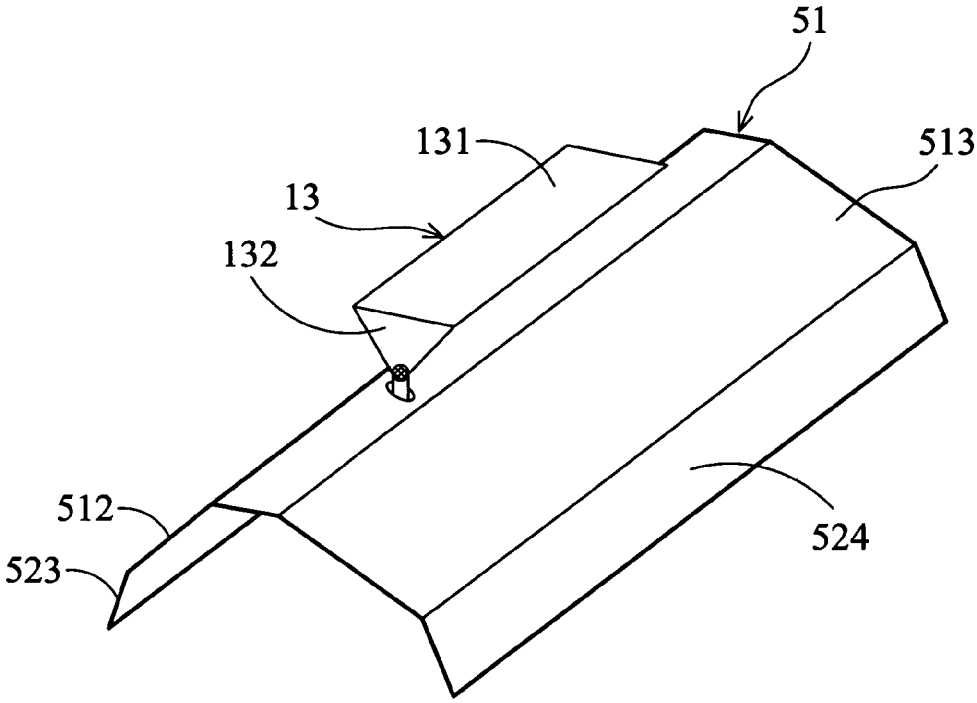
FIG. 5 is a perspective view of another embodiment of the antenna of the invention.

FIG. 5 shows the second embodiment of the antenna of the invention. In FIG. 5, in addition to the first ground surface described in the first embodiment, the ground unit 51 further comprises a second ground surface 512, a third ground surface 513, a fourth ground surface 523 and a fifth ground surface 524.

THIRD EMBODIMENT

Figure 6:
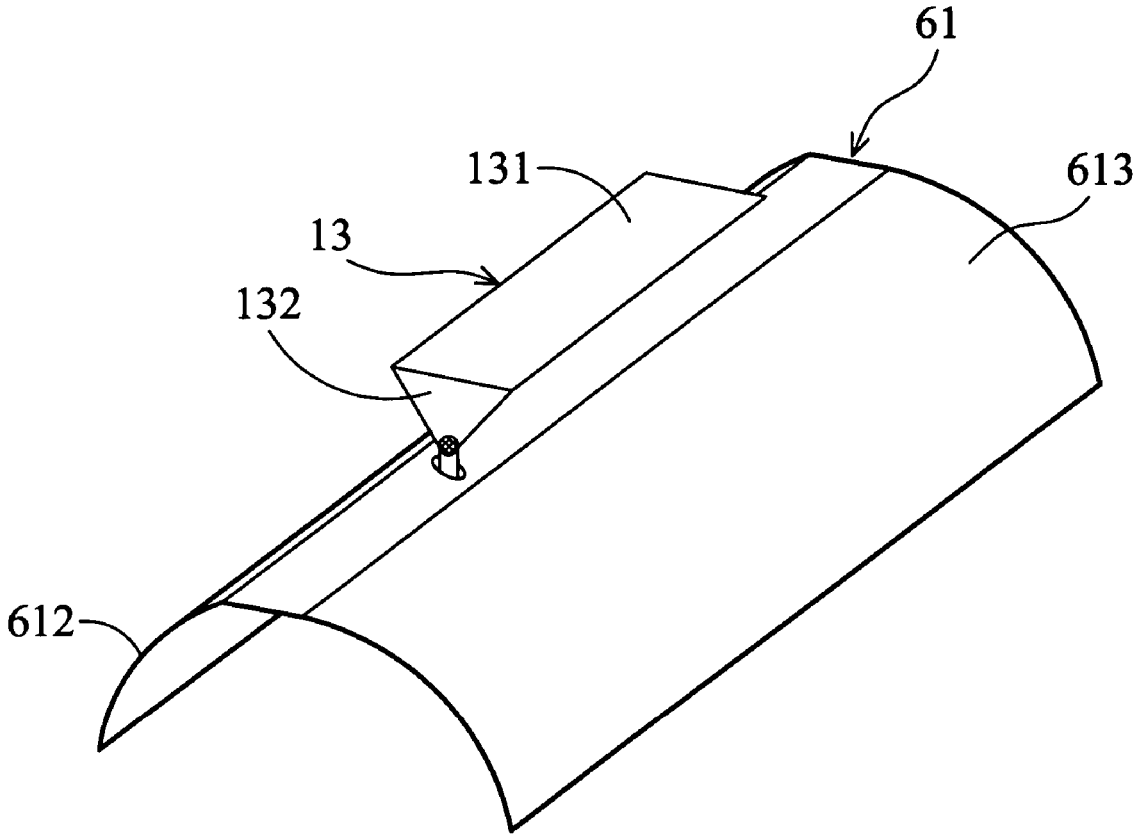
FIG. 6 is a perspective view of another embodiment of the antenna of the invention.

FIG. 6 shows the third embodiment of the antenna of the invention. In FIG. 6, in addition to the first ground surface described in the first embodiment, the ground unit 61 further comprises a curved second ground surface 612 and a curved third ground surface 613.

The antenna of the invention due to its small size and simple structure is easier to manufacture and offers reduced cost. The antenna of the invention is highly applicable to commercial use.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna, comprising:

a convex ground unit;

a radiating member disposed above the ground unit and comprising a first sub-radiating member and a second sub-radiating member having a feed point; and a feed member connected to the feed point, wherein the first sub-radiating member is only connected to the second sub-radiating member in such a manner that an angle is formed between the first and second sub-radiating members.

2. The antenna as claimed in claim 1, wherein the ground unit comprises:

a first ground surface having a first side and a second side opposite to the first side;

a second ground surface connected to the first side to define a first angle; and a third ground surface connected to the second side to define a second angle.

3. The antenna as claimed in claim 2, wherein the first angle is between 110° and 150°.

4. The antenna as claimed in claim 2, wherein the second angle is between 110° and 150°.

5. The antenna as claimed in claim 2, wherein the first ground surface has a via-hole through which the feed member extends without contact.

6. The antenna as claimed in claim 1, wherein the feed member is a metal rod.

7. The antenna as claimed in claim 2, wherein a bended metal plate forms the first, second and third ground surface.

8. The antenna as claimed in claim 2, wherein at least two metal plates form the first, second and third ground surface.

9. The antenna as claimed in claim 2, wherein the width of the first ground surface is less than ½ the width of the second ground surface.

10. The antenna as claimed in claim 2, wherein the width of the first ground surface is less than ½ the width of the third ground surface.

11. The antenna as claimed in claim 2, wherein the second and third ground surfaces are planar.

12. The antenna as claimed in claim 2, wherein the ground unit further comprises:

a fourth ground surface connected to the second ground surface opposite to the first ground surface; and a fifth ground surface connected to the third surface opposite to the first ground surface.

13. The antenna as claimed in claim 2, wherein the second and third ground surfaces are curved.

14. The antenna as claimed in claim 1, wherein the length of the first sub-radiating member is less than ½ the wavelength corresponding to the center operating frequency of bandwidth of the antenna.

15. The antenna as claimed in claim 1, wherein the distance between the first sub-radiating member and the first ground surface is less than ⅙ the wavelength corresponding to the center operating frequency of bandwidth of the antenna.

16. The antenna as claimed in claim 1, wherein aspect ratio of the first sub-radiating member is greater than 3.

17. The antenna as claimed in claim 2, wherein the first sub-radiating member is substantially parallel to the first ground surface.

18. The antenna as claimed in claim 2, wherein the second sub-radiating member is substantially perpendicular to the first ground surface.

19. The antenna as claimed in claim 1, wherein the second sub-radiating member is triangular, and an apex thereof is the feed point.

20. The antenna as claimed in claim 1, wherein a metal plate forms the radiating member.

21. The antenna as claimed in claim 1, wherein at least two metal plates form the radiating member.

* * * * *